US005343222A

United States Patent [19]

Saita et al.

[11] Patent Number: 5,343,222

[45] Date of Patent: Aug. 30, 1994

[54] DRIVING METHOD OF HEAT ELEMENT ARRAY

[75] Inventors: Yoshiaki Saita; Norimitsu Sanbongi; Yoshinori Sato, all of Tokyo, Japan

[73] Assignee: Seiko Instruments Inc., Japan

[21] Appl. No.: 781,745

[22] Filed: Oct. 23, 1991

[30] Foreign Application Priority Data

Oct. 24, 1990 [JP] Japan ..... 2-286615

[51] Int. Cl.[5] ..... B41J 2/35

[52] U.S. Cl. ..... 346/76 PH

[58] Field of Search ..... 346/76 PH; 400/120

[56] References Cited

U.S. PATENT DOCUMENTS

| | | | |
|---|---|---|---|
| 4,395,146 | 7/1983 | Arai | 346/76 PH |
| 4,679,056 | 7/1987 | Kobayashi et al. | 346/76 PH |
| 4,873,535 | 10/1989 | Sasaki | 346/76 PH |
| 5,220,349 | 6/1993 | Saita et al. | 346/76 PH |

*Primary Examiner*—Benjamin R. Fuller
*Assistant Examiner*—Huan Tran
*Attorney, Agent, or Firm*—Bruce L. Adams; Van C. Wilks

[57] ABSTRACT

An array of heat elements is driven by a driving circuit including a plurality of control units operative to sequentially carry out generation of heat efficiently even with using a relatively small capacity of a power supply and without relying on processing by CPU, thereby achieving fast heat generating operation while saving electric power. The thermal head is provided with a plurality of heat generating units each being comprised of a heat resistive element for generating heat by current flow and an electrode for supplying a current to the heat resistive element, and a plurality of switching elements for controlling supply of current to respective one of the heat generating units. The heat generating unit is constructed such that its resistance increases according to a temperature rising of the heat resistive element by the current supply so as to reduce an output of a driving current. The switching element is composed of, for example, a thyristor operative to turn off the current supply when the current flowing therethrough is reduced below a given level. A voltage between the switching element and the corresponding heat generating unit is monitored to detect the turning-off of the switching element so as to constitute a turning-off detector. The detection of the turning-off indicates the completion of the heat generation or the finish of current supply. Thus, after the detection of the turning-off, a next switching element is initiated to start generation of heat in an adjacent or subsequent heat generating unit.

13 Claims, 6 Drawing Sheets

DRIVING METHOD OF HEAT ELEMENT ARRAY

BACKGROUND OF THE INVENTION

The present invention relates to a sequential driving method of a heat element array having a function to self-regulate a heat amount of each heat element.

Conventionally, there has been utilized generally the block-divisional driving method to drive a thermal head comprised of a plurality of heat resistive elements in order to reduce power consumption. Namely, M×N number of the heat elements are divided into N number of blocks each containing M number of the heat elements. The respective blocks are driven in sequential manner.

There has been proposed another conventional method of controlling a number of heat elements to be driven concurrently. Namely, prior to application of a selection signal effective to determine selective driving and nondriving of the plurality of heat elements, the number of heat elements to be driven is counted provisionally. If the counted number exceeds a predetermined maximum limit number of heat elements which are allowed to driven concurrently, a part of all the selected heat elements is first driven at once. Then, the remaining selected heat elements are driven to thereby avoid exceeding the predetermined maximum limit number.

However, with regard to the conventional block-divisional driving method, the number of blocks should be increased so as to efficiently reduce a capacity of a power source. Such increase in the block number may disadvantageously increase a number of strobe signals used to time the driving of the blocks. Further, if each block is sequentially driven by mechanical means, a respective block may be unnecessarily strobed even if that block is not selected entirely for dot printing, thereby disadvantageously causing a loss time due to unnecessary strobe to an entirely nonselected block. Further, the electric power source must have a capacity sufficient to cover a maximum electric power output which occurs when all of the heat elements are turned on within one block, even though such a case occurs infrequently. Consequently, the capacity of the power source is not utilized efficiently.

With regard to the conventional drive number control method, it is necessary to provide a counter and to regularly adjust the selection signal for the predetermined maximum limit number, whereby a CPU is heavily involved in this adjustive control work requiring fast processing speed.

BRIEF SUMMARY OF THE INVENTION

A thermal head of the self-temperature control type is described in commonly owned U.S. patent application Ser. No. 599,258. This thermal head is provided with a plurality of heat generating units, each of which is comprised of a heat element of the resistor type effective to generate heat by a drive current and an electrode for supplying the drive current to the heat element, and a plurality of switching elements for controlling the supply of drive current to the respective heat generating units. The electrical resistance of the heat generating unit is raised according to a temperature rise of the heat element caused by the drive current, so as to reduce a supply of the drive current. The switching element turns the supply of the drive current off when the drive current is reduced below a predetermined level.

On the other hand, recently, portable information instruments are provided with a thermal recording device which must be powered by a battery. Thus, such a thermal recording device requires energy and power savings. The power savings are required even in the above mentioned thermal head of the self-temperature control type. However, if the conventional block-divisional driving method or the drive number control method is applied to the thermal head of the self-temperature control type, drawbacks may be caused such as a reduction in the processing speed of control signals, although the processing job is considerably reduced in the self-temperature control type device.

Thus, an object of the present invention is to provide an improved sequential driving technology of a thermal head of the self-temperature control type. According to the invention, turning-off of the switching element in a respective heat generating unit is detected during the current supply operation. A trigger signal is produced to initiate a subsequent switching element to enable current supply operation of a corresponding heat generating unit in response to the detection of the turning-off to thereby carry out fast sequential driving of the heat elements and to reduce the required capacity of the power source.

DETAILED DESCRIPTION OF THE INVENTION

Figure 1:
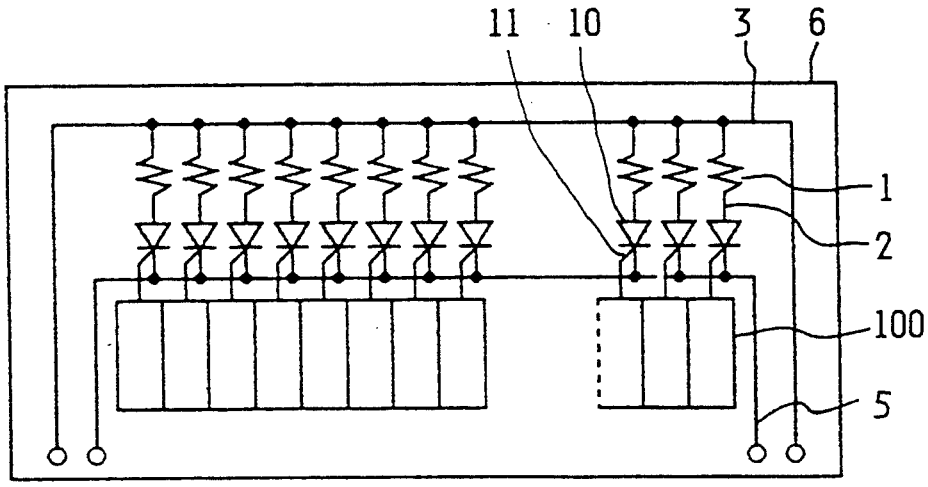
FIG. 1 is a plan view of a thermal head applied with the present invention.

Embodiments of the present invention will be described in detail with reference to the drawings. FIG. 1 is a plan view showing a first embodiment of the thermal head applied with the present invention. A substrate 6 is composed of alumina ceramics with glazing treatment, glass, or thermo-resistant resin having good heat-insulation. The substrate 6 is formed thereon with a plurality of heat elements 1 composed of a thin film of the specific type having a variable electroconductivity dependent on the temperature such that the thin film is metallic in a relatively low temperature range below several hundreds ° C., and is nonmetallic in a relatively high temperature range. Each heat element 1 of the variable resistor type is connected at its one end to a corresponding branch electrode 2, and is connected at its other end to a first common electrode 3 to thereby constitute each heat generating unit. Each branch electrode 2 is connected to a switching element 10 composed of a thyristor in the present embodiment. A second common electrode 5 is connected to each switching element 10. Alternatively to this embodimeent, switching elements and a second common electrode are not provided on the substrate of the thermal head, but may be separately provided in a peripheral circuit block.

Each heat element 1 is controlled to thermally undergo phase transition between a metal state and a nonmetal state according to a given recording dot data. Each heat element 1 is connected, in one-to-one relation, to each thyristor having a gate 11 receptive of a turn-on signal or a control signal at a given timing, effective to turn the thyristor on. A drive circuit 100 composed of buffers and logic gate elements is connected to process the control signal inputted into the gate 11 of each thyristor.

The first common electrode 3 is applied with a given positive potential and the second common electrode 5 is applied with a given negative potential. When the thyristor is turned on, a drive voltage substantially identical to the positive and negative potential difference is applied across the corresponding heat element 1 to flow therethrough a drive current. The heat element 1 of the resistor type generates joule heat by this drive current flow to raise its surface temperature. When the temperature of the heat element 1 reaches a phase transition point between the metal and nonmetal states of the thin film material which constitutes the heat element, the drive current flowing the heat element is reduced significantly on the order of $10^{-2}$ or $10^{-3}$, for example, in the case that the heat element is composed of vanadium oxide doped with $C_r$. The thyristor has suitable switching characteristics such that the thyristor is turned off by this substantial reduction of the current flow through the heat element. Once the thyristor is turned off, a further drive current is not supplied to the heat element unless the turn-on signal is applied again to the gate 11 of the same thyristor. Consequently, the heat element 1 stops the generation of heat. Namely, the heat element 1 is controlled to automatically stop generation of heat when its surface temperature reaches the phase transition point by the drive current flow. Then, the heat element stays in a cooling state until a next turn-on signal is inputted to the corresponding thyristor.

Figure 2:
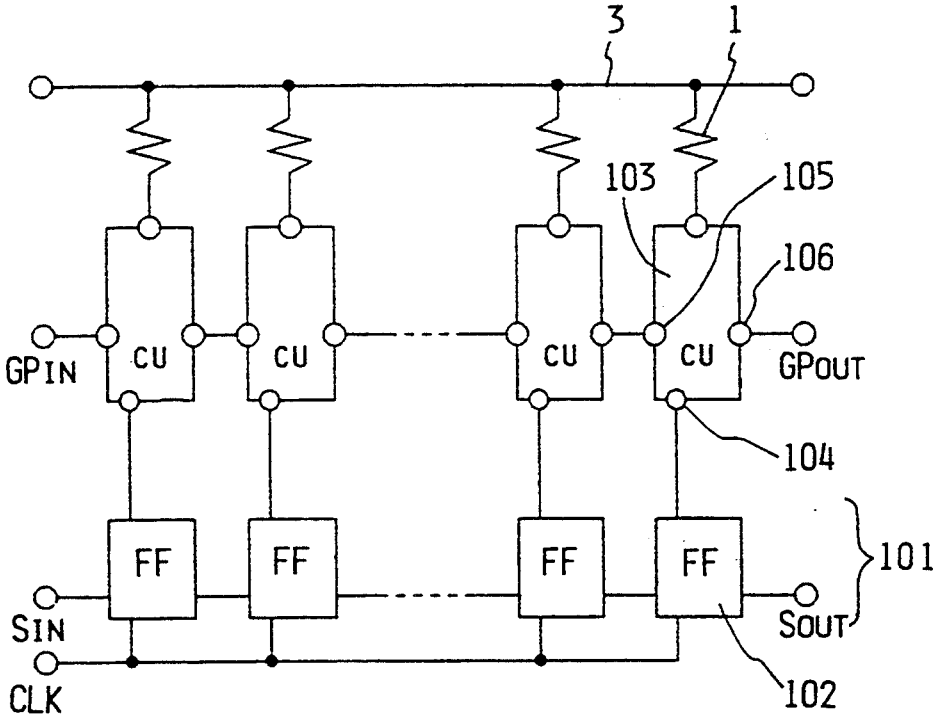
FIG. 2 is a block diagram of a drive circuit for the FIG. 1 thermal head.

FIG. 2 shows a construction of the drive circuit 100 for processing and outputting the turn-on signal which is fed to the gate of each thyristor. A shift register 101 is composed of D-type flipflops (FF) 102. The shift register 101 is inputted with a picture signal S containing a train of bit data each effective to determine whether a corresponding heat element is to be operated selectively to generate heat to record or print a dot. Each control unit (CU) 103 is provided correspondingly to each heat element. The unit 103 is provided with a bit data input terminal 104 receptive of an output from the corresponding flipflop 102, a trigger input terminal 105 receptive of a turn-on signal or a trigger signal effective to start the drive current supply to the heat element 1, a trigger output terminal 106 for outputting a subsequent trigger signal effective to start another current flow into an adjacent or next heat element.

Figure 3:
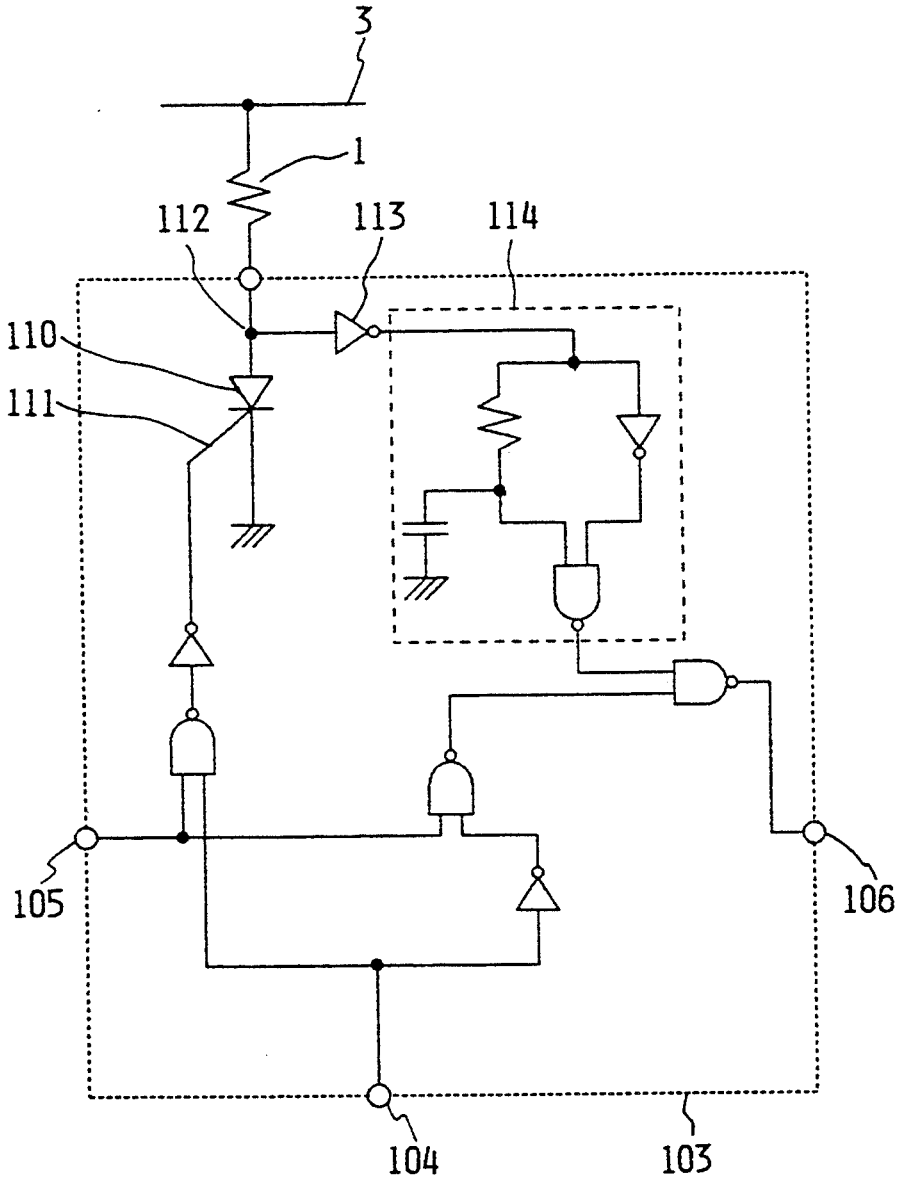
FIG. 3 is a detailed circuit diagram of a control unit provided in the FIG. 2 circuit.

FIG. 3 shows an example of the control unit 103. The bit data input terminal 104 receives selectively a bit data of a high level or an H level indicative of dot printing. In this condition, when the trigger input terminal 105 receives a trigger signal of a pulse which is raised from a low level or an L level to an H level, the pulse is transmitted to the gate 111 of the thyristor 110 to turn on the same to thereby start a drive current flow into the heat element 1. The thyristor 110 is never turned on when either of the bit data input terminal 104 and the trigger input terminal 105 is held at the L level.

An inverter 113 is connected to a junction node 112 between an anode of the diode thyristor 110 and the heat element 1. In the state where the common electrode 3 is supplied with the positive potential, an output of this inverter 113 is held to the H level when the thyristor 110 is turned on to effect the drive current flow into the heat element 1. On the other hand, the output of the inverter 113 is switched to the L level when the thyristor is turned off to stop the drive current flow. The inverter 113 is connected to a differentiated pulse generating circuit 114 including an integrating circuit comprised of a capacitor, a resistor and an inverter to perform delay function. The pulse generating circuit 114 operates to generate a pulse raised on the L level only when the output of the inverter 113 is switched from the H level to the L level. Stated otherwise, the circuit 114 generates a pulse only when the drive current has finished flowing to the corresponding heat element 1.

Figure 4A:
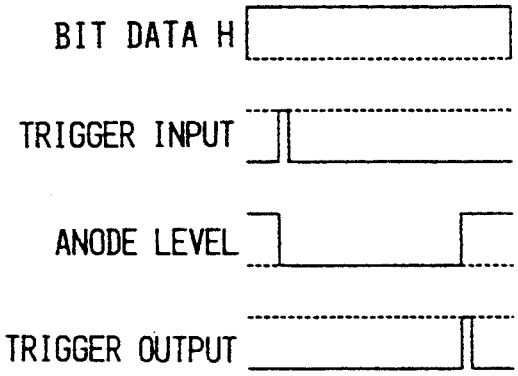
FIGS. 4A and 4B are timing charts showing operation of the FIG. 3 circuit.
Figure 4B:
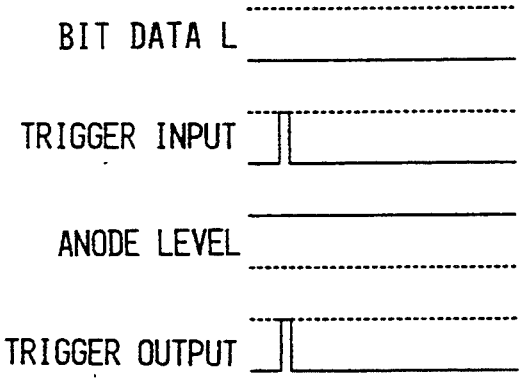

FIGS. 4A and 4B are timing charts showing the relation between the input states of the respective input terminals 104, 105 of the control unit 103 and the output state of the trigger output terminal 106, during the course of the above noted operation. As shown in FIG. 4A where the current bit data is set to H level to indicate dot printing, when a trigger signal is fed to the input terminal 105, the drive current supply is started to the corresponding heat element. Then, the drive current flow is suppressed due to resistance-temperature characteristics of the heat element to thereby turn off the thyristor. Concurrently, the trigger output terminal 106 outputs a subsequent trigger signal.

On the other hand, as shown in FIG. 4B where the bit data of the picture signal is set to L level indicative of no dot printing, even when a trigger signal is inputted into the trigger input terminal 105, the corresponding thyristor 110 is not turned on, while the inputted trigger signal is transmitted instantly as it is to the trigger output terminal 106 to thereby skip the current supply operation.

The trigger output terminal is connected to a subsequent trigger input terminal of a next control unit corresponding to an adjacent heat element, such that the selective driving of each heat element is sequentially and continuously carried out like the chain mode reaction according to a train of bit data of the picture signal. A heat element not to be driven is skipped to thereby ensure continuous driving of an array of the heat elements to eliminate a time loss.

As described above, respective ones of the control units 103 corresponding to the plurality of heat elements 1 are connected in series to one another to control driving the heat elements 1. By such operation, two or more of heat elements are never driven concurrently within a plurality of elements in which corresponding control units are connected in series. Consequently, a power source is required having only a small capacity that is sufficient to drive a single heat element. Further, the plurality of heat elements may be divided into several blocks. The control units 103 are connected in series within each block. An initial trigger signal $GP_{IN}$ is applied externally to a first heat element within each block. By such arrangement, a maximum number of heat elements to be driven concurrently is set identically to a number of the blocks. There can be used a power source having a current supply capacity sufficient to drive this number of elements concurrently, thereby efficiently achieving faster sequential driving.

Figure 5:
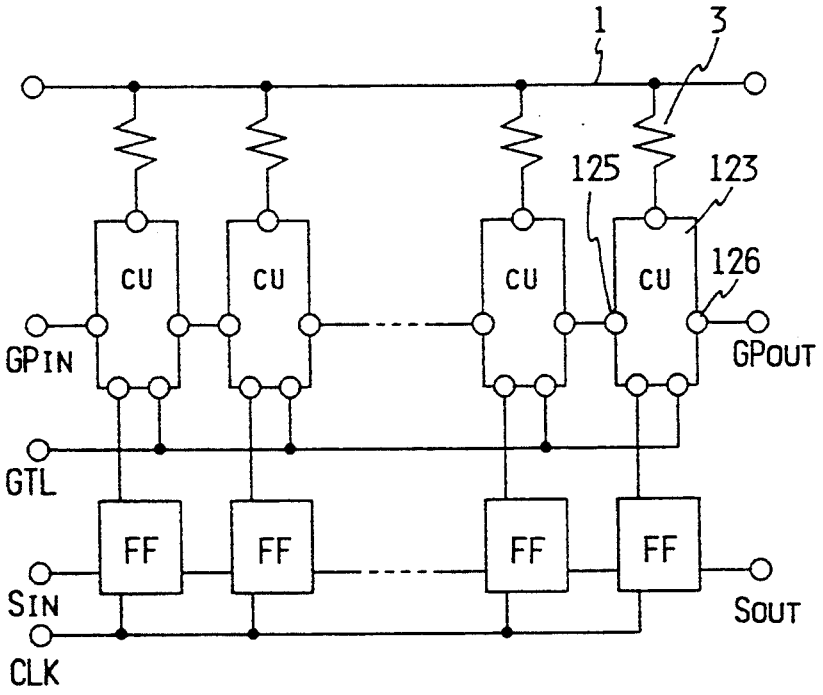
FIG. 5 is a block diagram showing another embodiment of the drive circuit for the thermal head.
Figure 6:
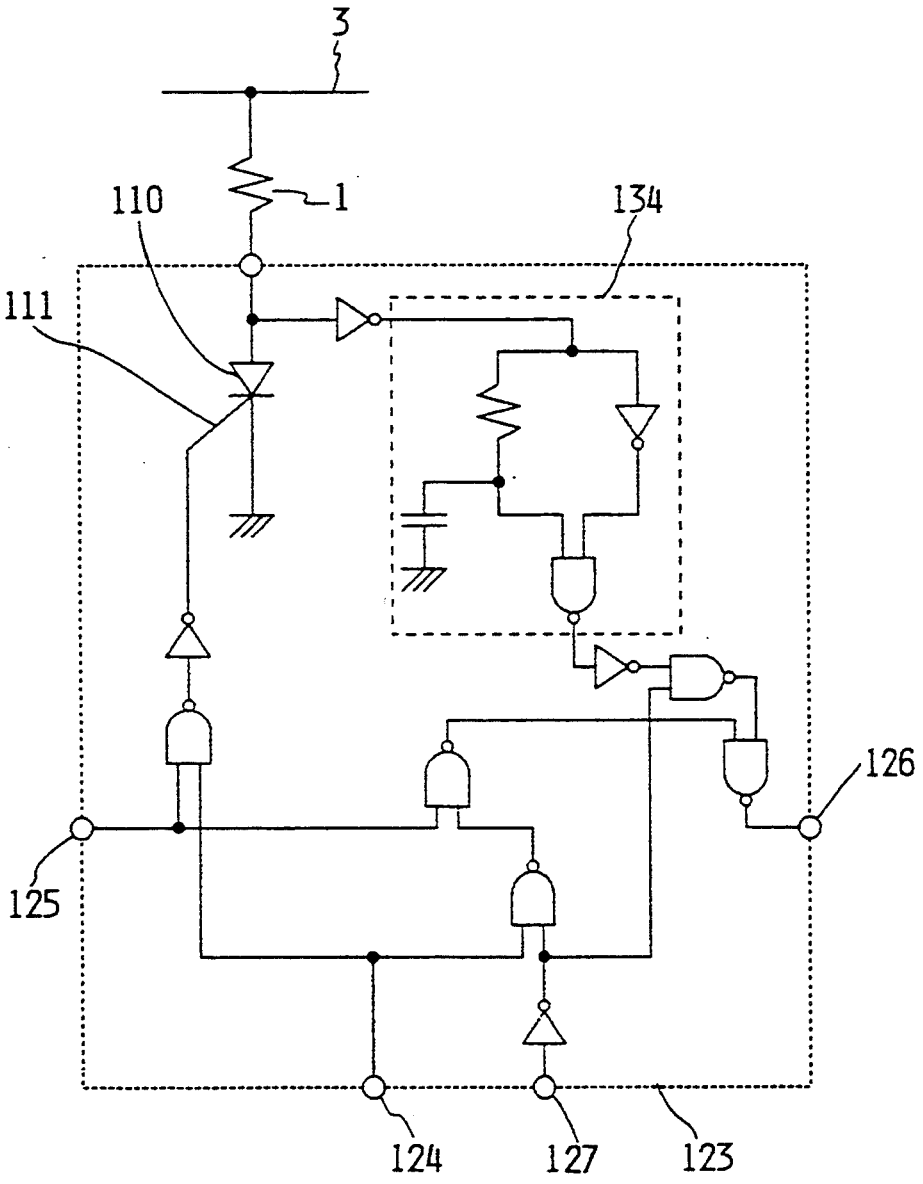
FIG. 6 is a detailed circuit diagram of a control unit provided in the FIG. 5 circuit.
Figure 7A:
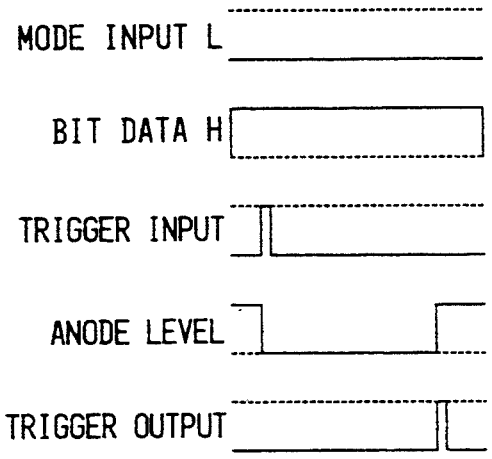
FIGS. 7A, 7B, 7C and 7D are timing charts showing the operation of the FIG. 6 circuit.
Figure 7B:
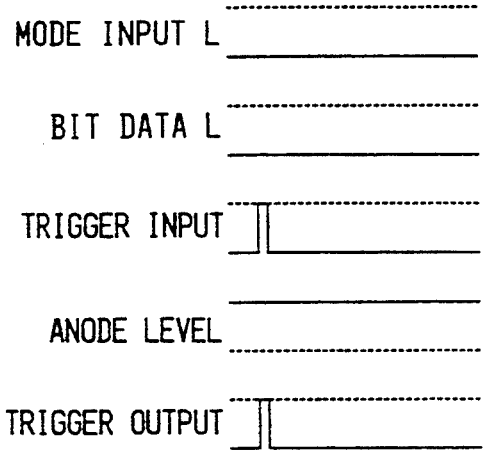
Figure 7C:
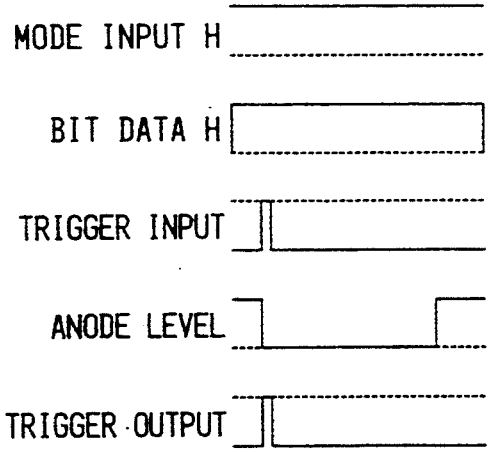
Figure 7D:
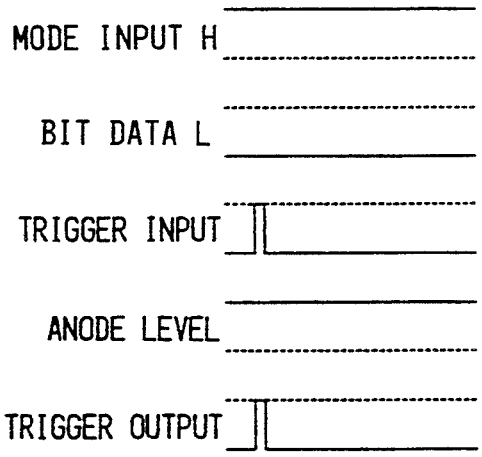

FIG. 5 is a block diagram showing a second embodiment of the inventive thermal head. Each control unit (CU) 123 has more generic function than the control unit 103 of the first embodiment. FIG. 6 shows an example of this control unit 123. FIGS. 7A, 7B, 7C and 7D are timing charts illustrating signal levels at respective input and output terminals of this control unit 123. The second embodiment features that each control unit is additionally provided with a mode-selection terminal 127. If each mode-selection terminal 127 is applied with an L level signal GTL, the plurality of serially connected control units operate in manner identical to those of the first embodiment.

On the other hand, if each mode-selection terminal 127 is supplied with an H level signal GTL, each control unit 123 operates such that a trigger signal inputted into the trigger input terminal 125 is instantly outputted as a subsequent trigger signal from the trigger output terminal 126 without regard to whether the corresponding heat element is to be selectively driven or not according to the applied bit data of the picture signal. Further, if the bit data of the picture signal is of the H level, the trigger signal enables a thyristor of that control unit to turn on the corresponding heat element. Moreover, though the differentiated pulse generating circuit 134 generates a pulse after the thyristor is turned off, such pulse is cut so that the trigger output terminal produces no delay output.

Namely in this embodiment, the mode-selection terminal 127 is provided to select either of the first mode in which individual heat elements are driven sequentially, and the second mode in which individual heat elements are driven concurrently to print dots. The sequential driving mode may be selected in case that the portable printer is powered by a battery which cannot supply a great current needed to enable concurrent driving of the heat element array. The concurrent driving mode may be selected in case that the printer is powered through an AC adapter effective to supply a great amount of the drive current to thereby enable fast processing. These two modes can be suitably selected according to a capacity of the power source and a size of printer.

Figure 8:
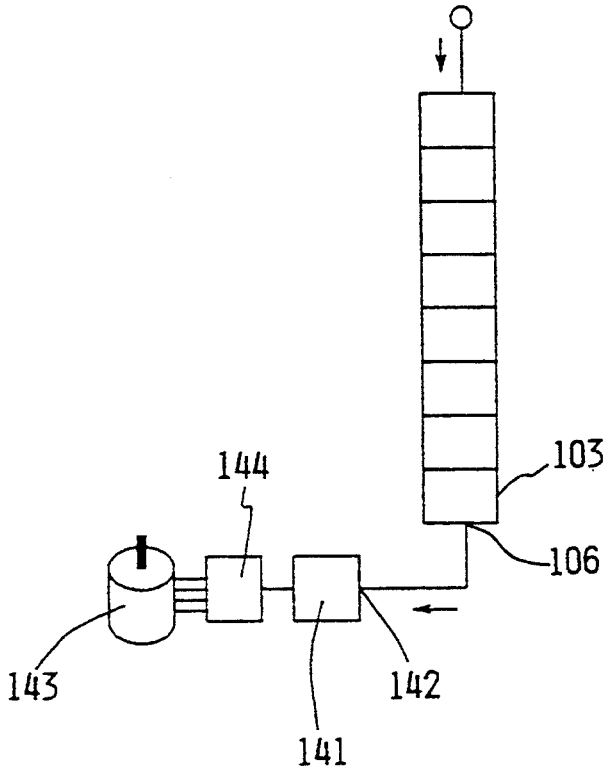
FIG. 8 is a block diagram showing a drive circuit for driving heat elements, and a motor driving control circuit of a thermal recording device according to the invention.

The next description is given for a third embodiment of the present invention. In a thermal printing device utilizing a thermal head, it is quite important to match a timing of driving operation of a linear heat element array with a timing of relative feeding operation of a thermally sensitive print paper sheet. If a relative feeding period of the print paper sheet were not matched to the one line operation period of the linear heat element array, a printed picture or image would be expanded or contracted in the relative feeding direction of the print medium. FIG. 8 is a block diagram including a control circuit 141 of a print sheet feeding motor 143 provided in a thermal printer device, wherein a final trigger signal outputted from the last control unit 103 or 123 of the first or second embodiment is utilized to trigger feeding operation of the print sheet.

In the thermal head of the first or second embodiment, print operation is carried out each line by heating of the linear heat element array. The sequential printing operation is internally processed by the set of control units 103 or 123, hence it is unclear when each line printing operation is finished. Further, a period of one line printing operation is considerably varied dependently on a number of heat elements to be driven within one line. In this regard, the last stage of the serially connected control units produces at its trigger output terminal a last trigger signal which indicates the completion of the sequential driving operation of the heat element array. Accordingly, as shown in FIG. 8, the final trigger signal of the last stage is applied to an input terminal 142 of the control circuit 141 so as to determine a drive timing of the motor 143 through a motor driver 144 for carrying out feeding of the print sheet relative to the thermal head. The motor 143 is driven stepwise by the driver 144 in response to a trigger pulse applied to the input terminal 142, thereby synchronizing the heating operation of the heat element array with the relative feeding operation of the thermally sensitive sheet.

The final trigger signal can be also utilized to initiate a next sequential heating operation after the heat element array has finished the present sequential heating operation, thereby simplifying construction of the recording device.

A described above, the present invention can provide driving technology of the heat element array to achieve the following various advantages:

1. A small number of input signals are provided to sequentially drive a plurality of heat resistive elements one by one to thereby reduce the processing requirements peripheral and external control circuit outside the thermal head.

2. Even if a number of heat elements to be selected is relatively small, only the selected heat elements are accessed to effect generation of heat to thereby prevent loss of operating time.

3. The final trigger signal from the last stage of the control units can be utilized as a timing signal for feeding of the recording sheet or as another timing signal for initiating a next sequential driving of the heat element array, thereby simplifying circuit construction of the device.

4. A number of the concurrently driven heat elements can be limited, thereby enabling efficient use of a small capacity power source.

Thus, the present invention can achieve power saving and control simplification of a thermal head device, a thermal recording device, a current-driven recording device and a thermal ink jet device.

What is claimed is:

1. A method for driving a thermal head having a plurality of heat generating units each comprised of a heat resistance element for generating heat by current supply and an electrode for supplying a current to the heat resistance element such that an electrical resistance of each of said heat generating units increases according to a temperature rise of the heat resistance element due to the current supply through the electrode so as to suppress an amount of the current supply, and a plurality of switching elements each for controlling the current supply to a corresponding heat generating unit, the method comprising: a first step of detecting reduction of the current supply in one of the heat generating units which has generated heat; and a second step of starting a switching element associated with a next heat generating unit which is to generate heat next, after the detection of the reduction in the current supply to said one heat generating unit, to thereby sequentially drive the heat generating units.

2. The method according to claim 1; wherein each of said switching elements includes means to turn off the current supply to the corresponding heat generating unit when an amount of current flowing therethrough is reduced below a predetermined amount.

3. The method according to claim 2; wherein the first step includes detecting turning-off operation of said each of said switching elements, and the second step is carried out after the detection of the turning-off operation so as to initiate current supply to a next heat generating unit.

4. A thermal head apparatus comprising: a plurality of heat generating units each comprised of a heat element effective to generate heat by current supply and an electrode for supplying a current to the heat element, an electrical resistance of each of said heat generating units being increased according to a temperature rise of the heat element due to flow of the current through the electrode to thereby suppress the current supply; a plurality of switching elements each for controlling the current supply to a corresponding one of said heat generating units; detecting means for detecting reduction of the current supply in the heat generating units; and trigger means for triggering a switching element associated with a next heat generating unit which is to generate heat next after the detection of the reduction in the current supply to thereby sequentially drive the heat generating units.

5. The thermal head apparatus according to claim 4; wherein each of said switching elements has a function to turn off the current supply to a corresponding one of said heat generating units when an amount of current flowing therethrough is reduced below a predetermined level.

6. The thermal head apparatus according to claim 5; wherein the detecting means includes means for detecting turning-off operation of said each of said switching elements, and the trigger means includes means for carrying out the triggering of a switching element associated with a next heat generating unit after the detection of the turning-off operation so as to initiate current supply to said heat generating unit.

7. The method for driving a thermal head having a plurality of heat generating units for generating heat in response to current supplied thereto under control of a plurality of switching elements each of which controls the current supply to a corresponding heat generating unit, each one of the heat generating units having an electrical resistance which increases according to a temperature rise thereof due to the current supplied thereto, the method comprising the steps of: detecting a reduction of the current supply to one of said heat generating units; and activating, in response to the reduction of the current supply to said one heat generating unit, a switching element associated with another of the heat generating units which is to generate heat next to thereby drive said another heat generating unit.

8. The method according to claim 7; wherein each of said heat generating units comprises a heat resistance element for generating heat in response to current supplied thereto, and an electrode for supplying current to the heat resistance element such that an electrical resistance of each of said heat generating units increases according to a temperature rise of the heat resistance element through the electrode.

9. The method according to claim 7; wherein each of said switching elements includes means for turning off the current supply to the corresponding heat generating unit when an amount of current flowing therethrough is reduced below a predetermined amount.

10. The method according to claim 9; wherein the detecting step includes detecting when a switching element associated with said one of said heat generating units turns off the current supply; and the driving step includes supplying current to the another heat generating unit after detecting the turning off of the current supply to said one of said heat generating units so as to sequentially drive the heat generating units.

11. The method according to claim 7; further comprising the steps of determining when a current has been supplied to a last one of the heat generating units; and feeding a printing medium relative to the thermal head to thereby synchronize the driving of the heat generating units with the feeding of the printing medium relative to the thermal head.

12. The method according to claim 7; wherein at least one of the switching elements comprises a thyristor.

13. The method according to claim 7; wherein at least one of the heat generating units comprises a thin film.

* * * * *